US005147263A

United States Patent [19]

Mueller

[11] Patent Number: 5,147,263

[45] Date of Patent: Sep. 15, 1992

[54] PNEUMATIC WEIGHT LIFT ASSIST APPARATUS

[76] Inventor: King L. Mueller, 143 Hillcrest Dr., North Platte, Nebr. 69101

[21] Appl. No.: 795,498

[22] Filed: Nov. 21, 1991

Related U.S. Application Data

[63] Continuation-in-part of Ser. No. 560,543, Jul. 30, 1990, abandoned.

[51] Int. Cl.[5] ..... A63B 21/008

[52] U.S. Cl. ..... 482/112; 482/99; 482/113

[58] Field of Search ..... 482/98, 99, 100, 101, 482/102, 103, 111, 112, 113

[56] References Cited

U.S. PATENT DOCUMENTS

| | | | |
|---|---|---|---|
| 123,804 | 2/1872 | Windship | 482/113 |
| 3,369,403 | 2/1968 | Carlin et al. | 482/113 |
| 3,387,843 | 6/1968 | Chandler | 482/113 |
| 3,587,319 | 6/1971 | Andrews | 482/112 |
| 3,976,057 | 8/1976 | Barclay | 482/113 X |
| 4,148,479 | 4/1979 | Spector | 482/112 |
| 4,540,171 | 9/1985 | Clark et al. | 482/99 X |
| 4,544,154 | 10/1985 | Ariel | 482/113 |
| 4,546,971 | 10/1985 | Raasoch | 482/113 |
| 4,566,692 | 1/1986 | Brentham | 482/113 |
| 4,601,467 | 7/1986 | Gvoich et al. | 482/113 |
| 4,601,468 | 7/1986 | Bond et al. | 482/113 |
| 4,651,986 | 3/1987 | Wang | 482/112 |
| 4,750,739 | 6/1988 | Ladge | 482/113 X |
| 4,765,610 | 8/1988 | Sidwell | 482/99 X |
| 4,765,611 | 8/1988 | MacMillan | 482/99 X |
| 4,779,864 | 10/1988 | Henson | 482/97 |
| 4,799,672 | 1/1989 | Barrett | 482/113 X |
| 4,848,738 | 7/1989 | Mueller | 482/113 |
| 4,951,941 | 8/1990 | Resk | 482/112 |
| 4,988,095 | 1/1991 | Ferrari | 482/112 X |

FOREIGN PATENT DOCUMENTS

| | | | |
|---|---|---|---|
| 3541823 | 6/1987 | Fed. Rep. of Germany | 482/112 |

*Primary Examiner*—Robert Bahr

*Attorney, Agent, or Firm*—Zarley, McKee, Thomte, Voorhees & Sease

[57] ABSTRACT

A pneumatic weight lift assist apparatus utilizes a cylinder with an air pressure powered piston. The air pressure power is provided by a vacuum pump driven by an electric motor. The piston is connected to a weight stack by a series of pulleys and a cable. The piston may also be connected directly to a handle to provide direct resistance to a weight lifter. The power output of the piston is controlled by a variable speed electronic switch connected to the pump motor.

4 Claims, 3 Drawing Sheets

PNEUMATIC WEIGHT LIFT ASSIST APPARATUS

CROSS-REFERENCE TO RELATED APPLICATION

This is a continuation-in-part application of application Ser. No. 07/560,543, filed Jul. 30, 1990, now abandoned.

TECHNICAL FIELD

The present invention relates generally to weight lifting apparatus, and more particularly to an improved pneumatic cylinder which provides variable assistance to a lifter.

BACKGROUND OF THE INVENTION

Modern research has determined that greater strength gains can be made if a muscle can continue to contract after reaching muscle failure. In current weight lifting programs this is done by a lifting partner who will physically assist the lifter when fatigue occurs. The assist usually consists of two or three repetitions after muscle failure.

SUMMARY OF THE INVENTION

The pneumatic weight lift assist apparatus utilizes a cylinder with an air pressure powered piston. The air pressure power is provided by a vacuum pump driven by an electric motor. The piston is connected to a weight stack by a series of pulleys and a cable. The piston may also be connected directly to a handle to provide direct resistance to a weight lifter.

The power output of the piston is controlled by a variable speed electronic switch connected to the pump motor. Other variables such as pump capacity and cylinder volume can also be varied to induce different power ranges.

The device can be activated by the user through the use of a foot or hand switch depending on the exercise being performed. When the system is activated, the piston provides a smooth power surge that will aid the user through the lift. When deactivated the weight stack returns to its original position, thus returning the piston to its original position. When the system is not being used it will not interfere with the normal operations of the weight lifting machine.

BRIEF DESCRIPTION OF THE DRAWINGS

Some of the objects of the invention having been stated, other objects will appear as the description proceeds, when taken in connection with the accompanying drawings, in which.

DESCRIPTION OF THE PREFERRED EMBODIMENT

While the present invention will be described hereinafter with particular reference to the accompanying drawings, in which an operating embodiment of the apparatus of the present invention is shown, it is to be understood at the outset of the description which follows that it is contemplated that apparatus and methods in accordance with the present invention may be varied from the specific form described hereinafter while still attaining the desired result of this invention. Accordingly, the description which follows is to be understood as a broad teaching disclosure directed to persons of appropriate skill in the appropriate art, and not as limiting upon the scope of this invention.

Figure 1:
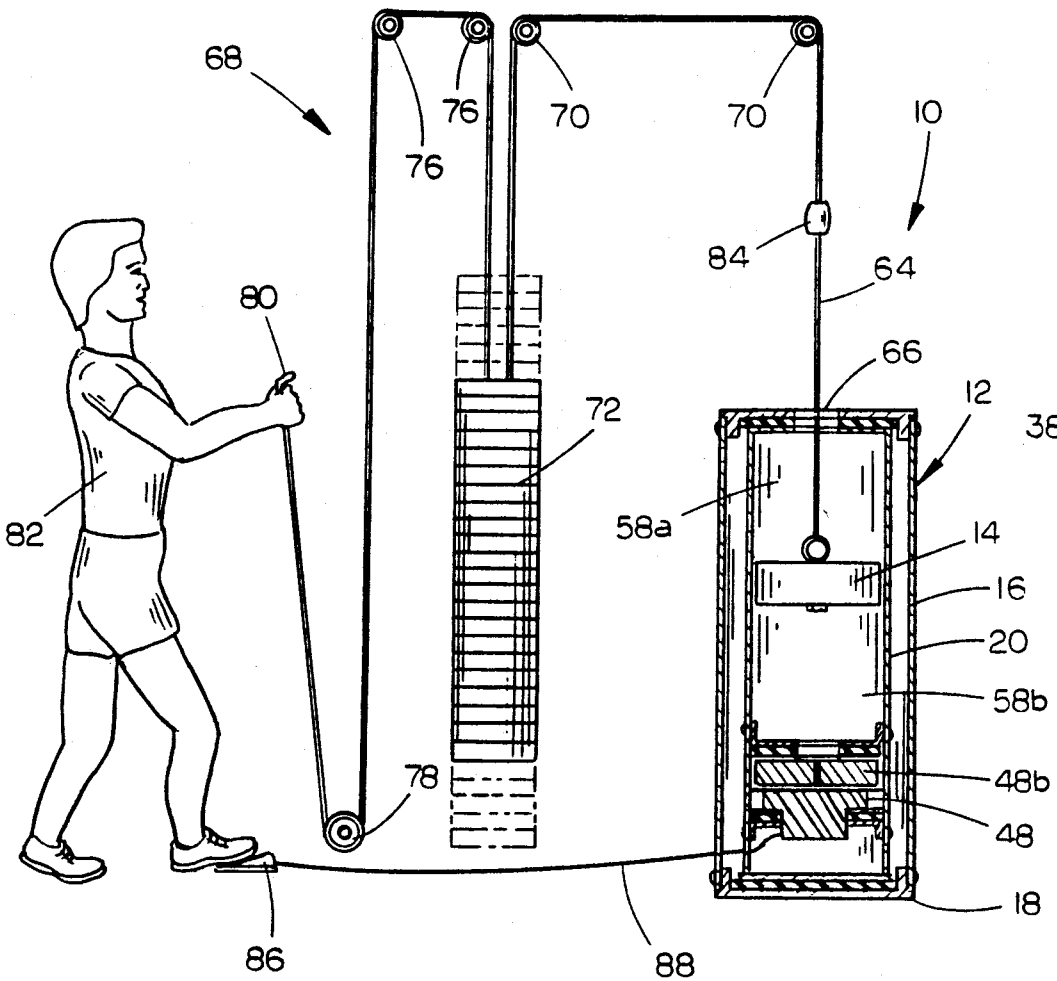
FIG. 1 is a cross-section of the invention connected to a weight stack.

Referring now to FIG. 1, the pneumatic weight lighting assist apparatus of the present invention is designated generally at 10 and includes a main cylinder 12 having an operable piston 14 mounted therein for vertical slidable movement. Cylinder 12 includes an outside pipe 16 mounted to a base 18 to stand upright therefrom.

Figure 3:
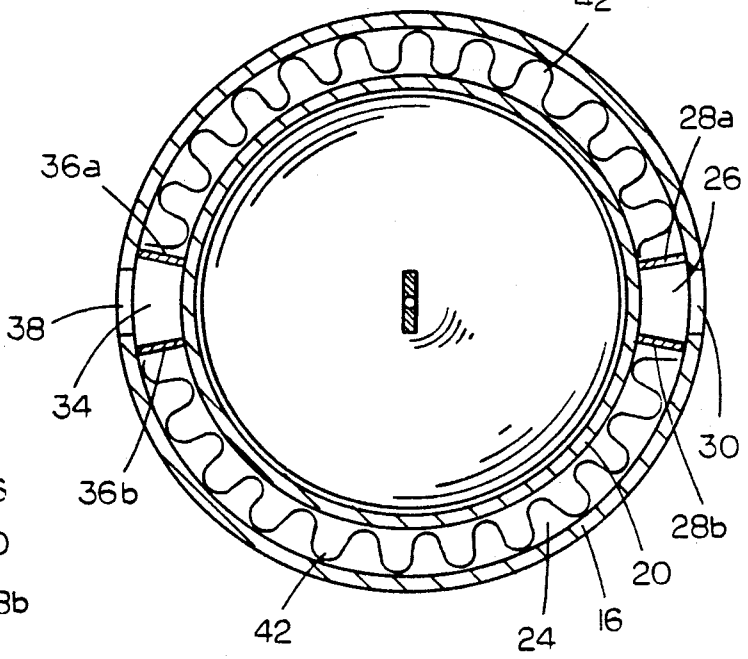
FIG. 3 is a cross-section taken at lines 3—3 in FIG. 2.
Figure 2:
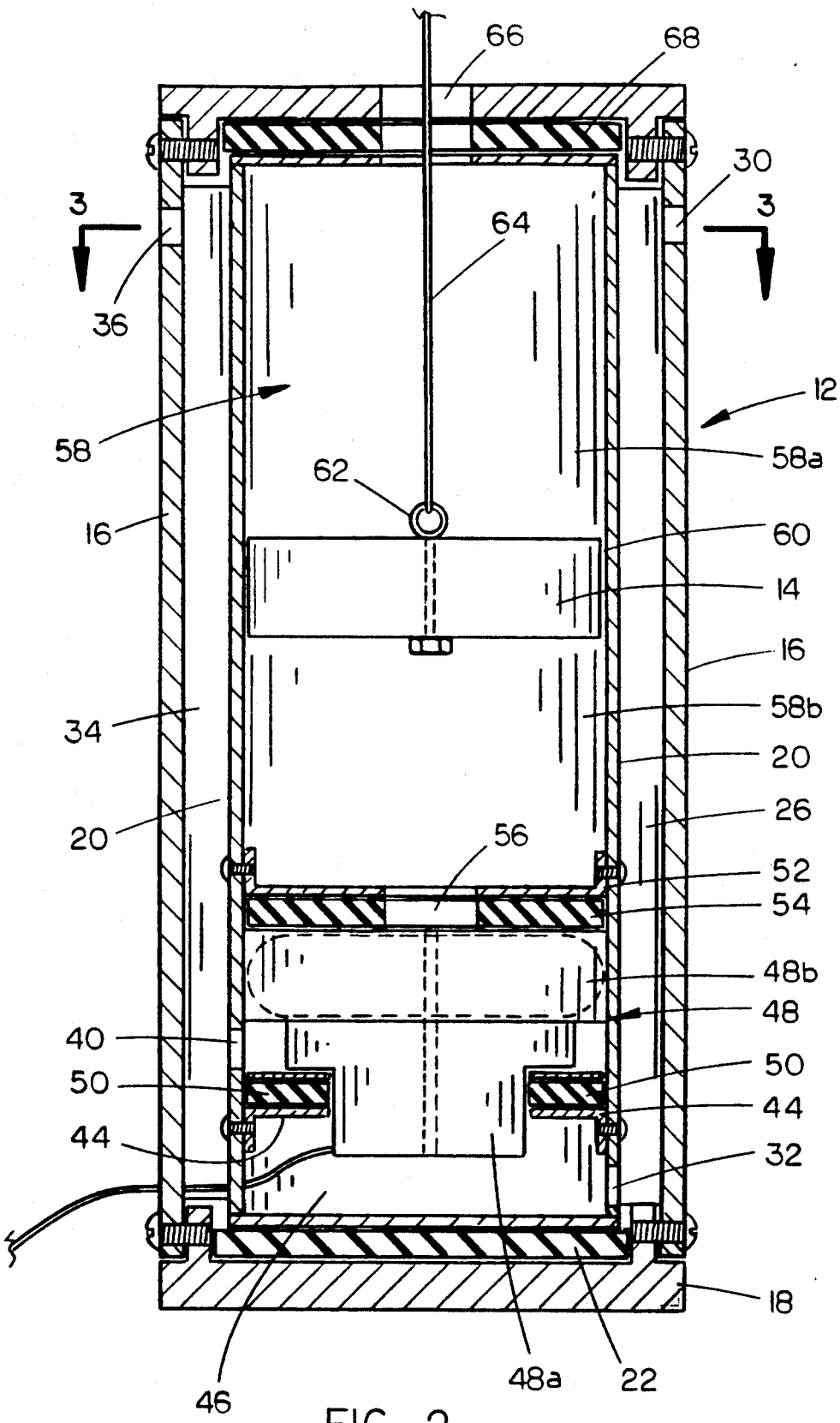
FIG. 2 is an enlarged cross-section.

Referring now to FIG. 2, an inner cylinder 20 is mounted within pipe 16 and rests on a resilient base pad 22 on base plate 18. The outside diameter of inner cylinder 20 is less than the interior diameter of pipe 16 so as to form an annular air space 24 between inner cylinder 20 and pipe 16, as shown in FIG. 3. A vertical air channel 26 is formed between a pair of vertical walls **28*a* and 28*b* formed between inner cylinder 20 and pipe 16. Air channel 26 extends from an intake port 30 through the upper end of pipe 16 downward to a second port 32 (see FIG. 2) through the lower end of inner cylinder 20 to permit the flow of air from outside pipe 16 to the interior of inner cylinder 20. A second vertical air channel 34 is formed diametric of air channel 26 by walls 36*a* and 36*b* between inner cylinder 20 and pipe 16. Air channel 34 extends from an exhaust port 38 through the upper end of pipe 16 downwardly to a second port 40 spaced above the lower end of inner cylinder 20**.

As shown in FIG. 3, annular air space 24 is filled with insulation 42 between air channels 26 and 34, to dampen noise and vibration of the apparatus 12.

A pair of pump mounting brackets 44 are mounted within the lower end of inner cylinder 20 and spaced above the bottom thereof to form a lower air chamber 46. A vacuum pump 48 rests atop a resilient pad 50 on mounting brackets 44 with the electric motor portion **48*a* extending downwardly into air chamber 46. The pump rotors 48*b*** are shown in hidden lines in FIG. 2.

An upper mounting bracket 52 has a resilient pad 54 mounted to its lower surface and serves to maintain air pump 48 in a fixed position within inner cylinder 20. A large opening 56 permits air movement from the piston chamber 58 formed above upper mounting bracket 52, to the rotor blades **48*b* of the vacuum pump 48. Piston 14 has an exterior diameter which is slightly less than the inner diameter of inner cylinder 20 such that a small annular air space 60 is formed around the piston 14. Air space 60 permits the leakage of air between the upper portion of the piston chamber 58*a* (above piston 14) and the lower portion of the piston chamber 58*b*, for a purpose described in more detail hereinbelow. An eyebolt 62 is fastened through the center of piston 14, to which a cable 64 is attached which extends through an opening 66 in the upper end of pipe 16, and inner cylinder 20. A resilient pad 68 is mounted between the upper ends of pipe 16 and inner cylinder 20 to resiliently maintain inner cylinder 20 within pipe 16**.

Referring now to FIG. 1, the weight lift assist apparatus 10 is shown in conjunction with a weight machine 68. Weight machine 68 is shown in schematic version to convey the general concept of the present invention. Cable 64 extends from piston 14 over a pair of pulleys 70 and thence down to a weight stack 72. A second cable 74 extends upwardly from weight stack 72, parallel to cable 64, thence over a pair of pulleys 76 down around a lower pulley 78 and thence upward to a handle 80. A lifter 82 thereby applies a force to handle 80 to raise a portion or all of weight stack 72. A weight 84 is preferably attached to cable 64 immediately above cylinder 12, so as to maintain tension on cable 64 on weight stack 72, so as to keep cable 64 on pulleys 70 when the weight lift assist apparatus 10 is not being operated.

When the lifter fatigues and requires assistance, the lifter simply presses the foot switch 86, which sends an electrical circuit through cord 88 to vacuum pump 48. Activation of pump 48 creates a low pressure in lower portion 58*b* of air chamber 50*a*, thereby causing piston 14 to be pushed downwards by the greater surrounding air pressure in the upper portion 58*a* of air chamber 58. This downward force of piston 14 will lift weight stack 72, providing the necessary assistance to lifter 82. When the assistance is no longer needed, foot switch 86 is released, vacuum pump 48 will stop, and air will be drawn through pump 48 and rotor blades 48*b* into lower portion 58*b* of air chamber 58 thereby equalizing the air pressure within inner cylinder 20. Weight stack 72 will thereby be returned to its rest position, which draws piston 14 upwardly to a starting position. Foot switch 86 includes a variable speed electronic switch so as to control the amount of force applied by vacuum pump 48.

Figure 4:
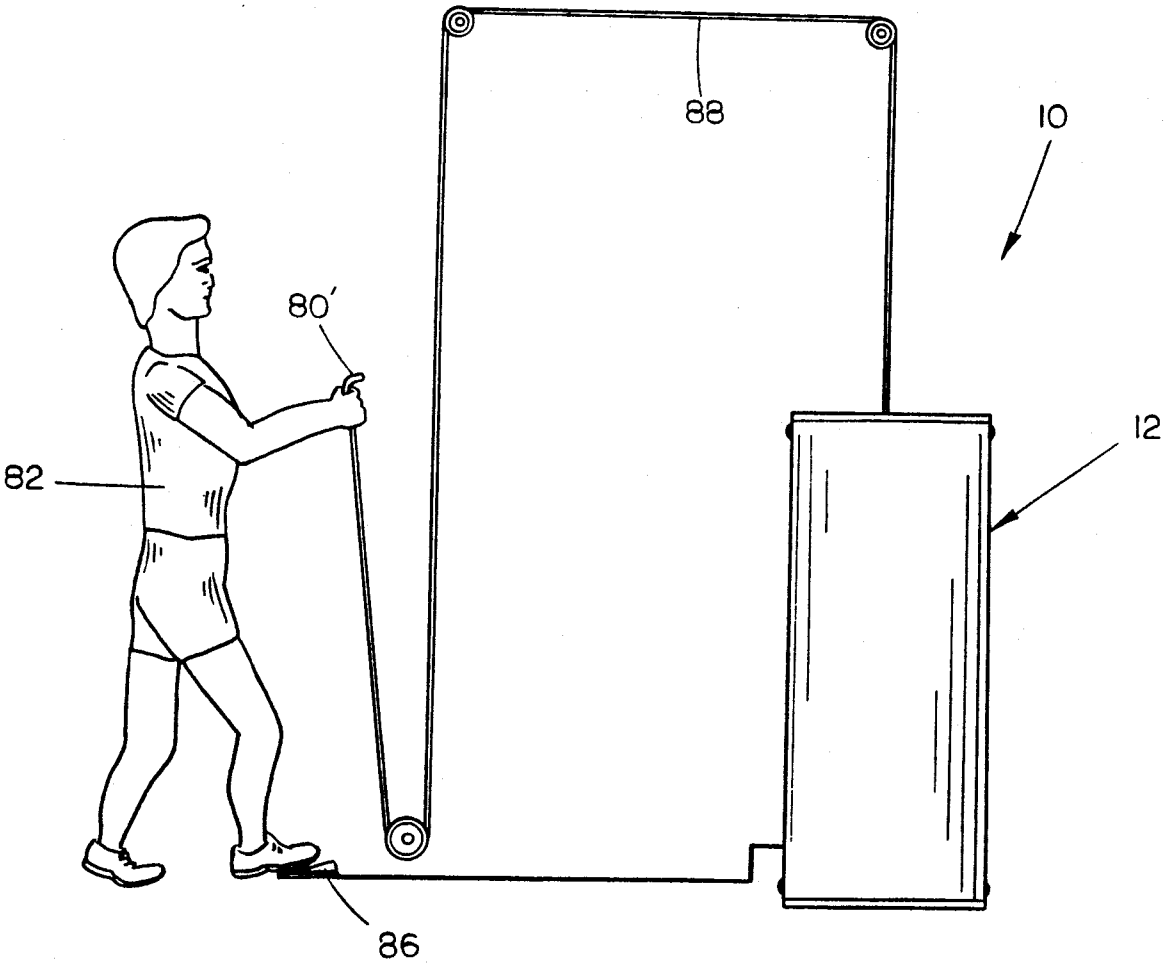
FIG. 4 is an elevational view of the invention connected to a weight lifitng machine.

Referring now to FIG. 4, weight lift assist apparatus 10 may also be connected to a cable 88 which is connected directly to a handle 80', so that cylinder 12 may be used as the direct opposing force for a lifter 82. As shown in FIG. 2, activation of vacuum pump 48 will apply a biasing force on piston 14, which in turn is applied to handle 80' (as shown in FIG. 4). Use of the variable electronic switch in foot switch 86 permits the amount of force applied to handle 80' to be selectably controlled. Lifter 82 overcomes the biasing force applied by pump 48 by lifting on handle 80'. Air leakage through air space 60 around piston 14, in combination with air which leaks through rotor blades 48*b*, permits piston 14 to be drawn upwardly against the biasing force of the vacuum pump 48. When fatigue occurs, the lifter can complete the repetition by decreasing the speed of the electronic motor on pump 48.

I claim:

1. A weight lifting assist apparatus, for use with a weight machine of the type having a cable operably extending through a series of pulleys to a handle, comprising:

a hollow upright cylinder having upper and lower ends;

a piston operably mounted within said cylinder for reciprocal vertical movement;

said piston having an outer diameter smaller than the inner diameter of the cylinder, to form an annular space therebetween which permits leakage of fluid past the piston;

the upper end of said cylinder having an opening formed therein through which said weight machine cable will extend for connection to said piston, said opening permitting the entrance of fluid into said cylinder above said piston;

means connected to said cylinder for selectively producing vacuum pressure in said cylinder below said piston, to place a downward force on said piston and apply a force to said cable;

means connected to said vacuum pressure producing means for selectively varying the vacuum pressure in the cylinder, and thereby vary the force applied to the cable; and said vacuum pressure producing means including a port in said cylinder below said piston for the passage of fluid out of the cylinder.

2. The apparatus of claim 1, wherein said vacuum pressure producing means includes an electrically operated vacuum pump.

3. The apparatus of claim 1, further comprising:

a hollow, tubular pipe having an open upper end and a closed lower end;

said cylinder mounted coaxially within said pipe, said pipe having an inner diameter greater than the outer diameter of the cylinder, to form a cylindrical space therebetween;

sound insulative material installed between said cylinder and said pipe to substantially fill said cylindrical space;

a port in the upper end of said pipe communicating between the cylindrical space and the exterior of the pipe;

an air channel formed between said pipe port and said cylinder port for the passage of fluid out of the cylinder; and a cap on the upper end of the pipe, with an aperture therein aligned with said cylinder opening for said cable and the passage of fluid therethrough.

4. The apparatus of claim 2, wherein said means for selectively varying the vacuum pressure includes a variable electronic switch which selectively varies electrical current provided to said vacuum pump.

* * * * *